United States Patent [19]

Hohmann

[11] Patent Number: 4,875,319

[45] Date of Patent: Oct. 24, 1989

[54] SEISMIC CONSTRUCTION SYSTEM

[75] Inventor: Ronald P. Hohmann, Syosset, N.Y.

[73] Assignee: Hohmann & Barnard, Inc., Hauppauge, N.Y.

[21] Appl. No.: 205,673

[22] Filed: Jun. 13, 1988

[51] Int. Cl.[4] ..... E04B 1/16

[52] U.S. Cl. ..... 52/383; 52/508; 52/713

[58] Field of Search ..... 52/379, 383, 513, 508, 52/713, 710, 396

[56] References Cited

U.S. PATENT DOCUMENTS

| | | | |
|---|---|---|---|
| 1,854,633 | 4/1932 | Stephens | 52/713 X |
| 3,385,016 | 5/1968 | Crom | 52/396 X |
| 3,707,815 | 1/1973 | Molyneux | 52/710 X |
| 3,808,762 | 5/1974 | Hurst | 52/396 X |
| 4,021,990 | 5/1977 | Schwalberg | 52/564 X |
| 4,131,382 | 12/1978 | Hymo | 52/396 X |
| 4,596,102 | 6/1986 | Catani et al. | 52/508 |
| 4,603,527 | 8/1986 | Vercelletto | 52/710 X |
| 4,606,163 | 8/1986 | Catani | 52/513 X |

*Primary Examiner*—Carl D. Friedman
*Attorney, Agent, or Firm*—Philip D. Amins

[57] ABSTRACT

A seismic construction system for use in anchored veneer wall constructions which utilizes an inner and an outer wythe includes a veneer anchor member which is attached to the vertical channel of an inner wythe, a tie member which is attached to the veneer anchor member, a clip member which is attached to the tie member and a continuous reinforcing wire secured to the clip member which is embedded in the mortar joint together with the clip member during the construction of the outer wythe. The continuous reinforcing wire, the clip and the tie member, once embedded in the mortar joint, form a rigid connection which provides a high degree of seismic protection yet facilitates rapid and cost saving construciton.

43 Claims, 2 Drawing Sheets

SEISMIC CONSTRUCTION SYSTEM

BACKGROUND OF THE INVENTION

Recent investigations related to the effects of earthquakes upon building structures has demonstrated the advantages of having a continuous wire embedded in the mortar joint of anchored veneer walls. These investigations have resulted in the incorporation of a requirement for this type of continuous wire reinforcement in the Uniform Building Code for seismic zones. The code requires that this wire is to be secured to the tie anchor which is fastened to the support structure. The use of a continuous wire in masonary veneer walls has been found to have additional benefits in providing protection against problems arising from thermal expansion and contraction and improving the uniformity of the distribution of the lateral forces in a structure.

OBJECTS OF THE INVENTION

It is an object of the present invention to provide a seismic construction system which allows the incorporation of continuous wire reinforcement in the mortar joint of anchored veneer walls.

It is another object of the present invention to provide a seismic construction system which allows for the installation of continuous wire reinforcement in a rapid labor saving manner.

It is yet another object of the present invention to provide a seismic construction system which incorporates continuous wire reinforcement and which allows a degree of vertical adjustibility while providing listed horizontal movement.

It is yet a further object of the present invention to provide a seismic construction system which comprises a limited number of component parts which are economical of manufacture resulting in a relatively low unit cost.

SUMMARY OF THE INVENTION

In accordance with the present invention, there is provided a seismic construction system which includes a vertical channel member, a veneer anchor member, a wall tie member, a clip member and a reinforcing wire. The vertical channel member is part of an inner wythe construction which may be in the nature of rigid wall board and a conventional insulation layer. The veneer anchor member is attached to the vertical channel member by means of a pair of screws and the wall tie member is attached to a projecting portion of the veneer anchor member. The clip member, comprising one of the novel features of the present invention, is attached to the wall tie member. The clip member has a plurality of channels two of which accept leg portions of the clip member. Additional channels are proportioned to accept a continuous reinforcing wire or rod. The clip member is attached to the wall tie member and its placed in the mortar joint during the construction of an outer wythe and a continuous reinforcing wire is placed in one of the channels of the clip member. As construction of the outer wythe continues, the clip member, the ends of the wall tie member and the continuous reinforcing wire are covered by mortar forming a rigid and seismically effective connection between the inner and outer wythes.

BRIEF DESCRIPTION OF THE DRAWINGS

The foregoing other objects, features and advantages of the present invention will become more apparent from the detailed description hereinafter when considered in conjunction with the accompanying drawings wherein.

DETAILED DESCRIPTION OF THE PREFERRED EMBODIMENT

Figure 1:
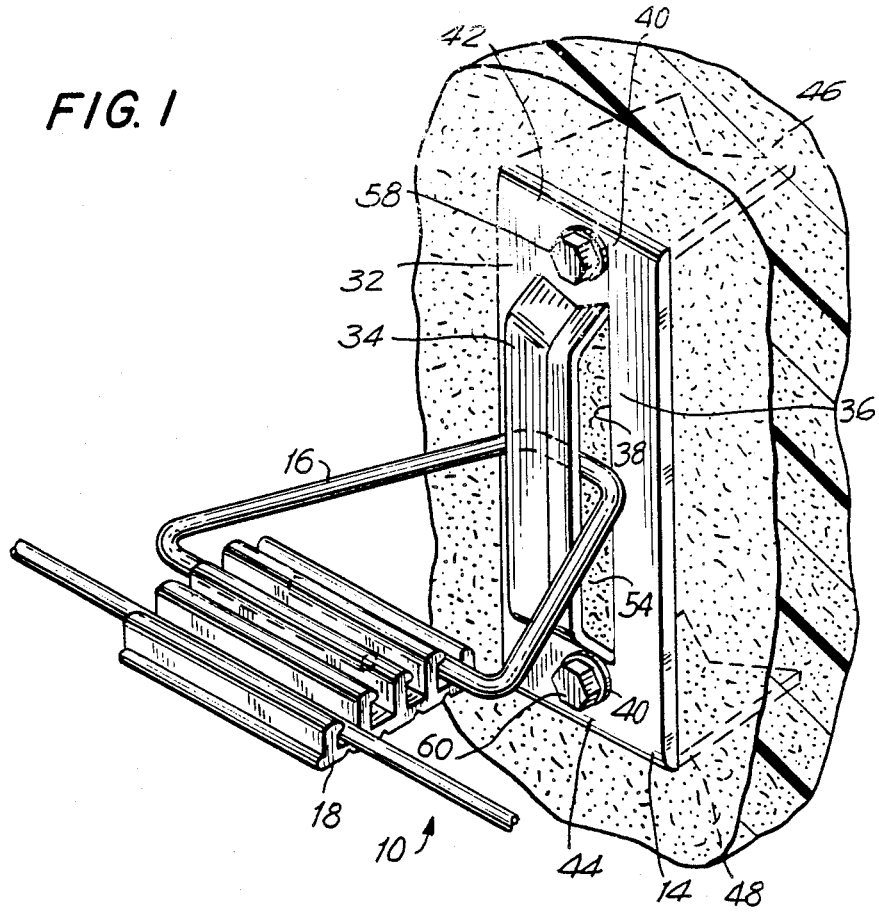
FIG. 1 is a fragmentary perspective view of a seismic construction system fabricated in accordance with the principles of the present invention with the system shown in use.

Referring now to the drawings, and more particularly, to FIG. 1 thereof, there is depicted a new and novel seismic construction system, generally denoted by the reference numeral 10 and fabricated in accordance with the principles of the present invention.

The system comprises a vertical channel member 12, a veneer anchor member 14, a wall tie member 16, a clip member 18, a reinforcing wire or rod member 20, an inner wythe 22, and an outer wythe 24. The outer wythe 24 which is herein illustrated by a plurality of individual brick members 26 but, as will be readily apparent to those skilled in the art, may be constructed of stone, cinder blocks or other similar masonry materials which may have regular or irregular configurations.

In a similar manner, the inner wythe 22 may be constructed of any suitable material. It is noted that in the preferred construction, the inner wythe 22 includes a rigid wall board layer 28 and an insulation layer 30, preferably of expanded foam material.

The veneer anchor member 14 comprises a backing plate member 32 and a projecting bar portion 34. The projecting bar portion 34 is punched out from the central portion 36 of the backing plate member 32 so as to result in a centrally disposed aperture 38, of substantially rectangular configuration, being formed in the backing plate member 32. The projecting bar portion 34 is thereby disposed in substantially parallel relationship with respect to said backing plate member 32. The backing plate member 32 is provided with bores 40 at the upper and lower ends 42,44 thereof the purpose of which will presently be described.

The veneer anchor member 14 includes end members 46,48 which are bifurcated as shown at end 46 to form prong portions 50,52. The projecting bar portion 34 is sufficiently spaced from the plate member 32 so as to form a slot 54 which is adapted to receive the wall tie member 16.

Figure 2:
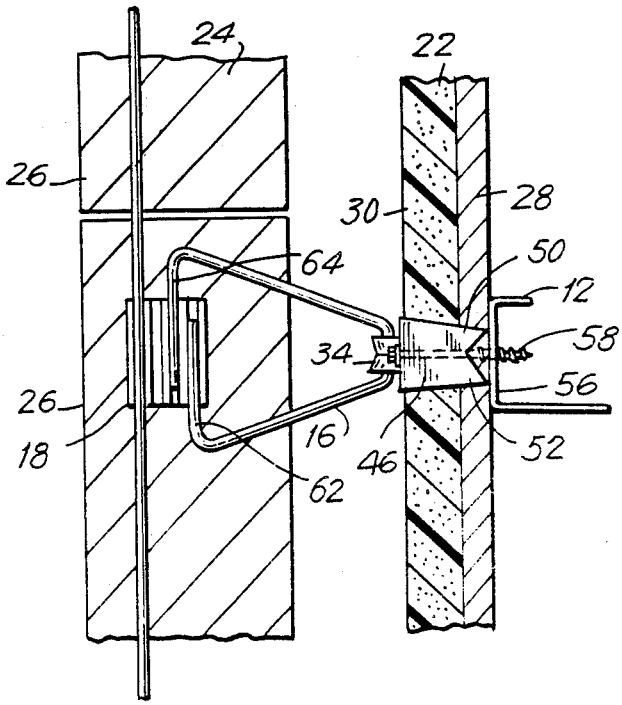
FIG. 2 is a top view of the system of FIG. 1.
Figure 3:
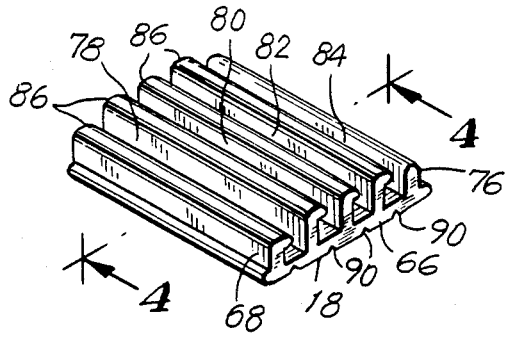
FIG. 3 is a perspective view of the clip member of the system of FIG. 1.

In the fabrication of the seismic construction system 10, the vertical channel members 12 are initially secured in place. The vertical channel members 12 may be the standard framing members of an edifice. The rigid wall board 28 which may be an exterior grade gypsum board is positioned in abutting relationship with the front portion 56 of the vertical channel member 12. The inner wythe 22 may include an insulating layer 30 which is disposed in abutting relationship with the wall board layer 28. After placement of the insulating layer 30, the veneer anchor member 14 is secured to the channel member 12 by forcing the prong portions 50,52 through the insulating layer 30 and the wall board 28 until the prong portions 50,52 abuttingly engaged the front portion or surface 56 of the channel member 12, as is best shown in FIG. 2. Sheet metal screws 58,60 are inserted into the bores 40 to fasten the veneer anchor member 14 with respect to the channel member 12. Subsequently, the wall tie member 16 is inserted in the slot 54 formed between the projecting bar portion 34 and the back plate member 32 and the clip member 18 is attached to the wall tie member 16. Thereafter, fabrication of the outer wythe 24 is commenced utilizing the stones 26 with horizontal and vertical joints filled with mortar in a conventional manner which is not shown.

The wall tie member 16 is generally similar to the wall tie member which has been described in U.S. Pat. No. 4,021,990 and reference is had thereto for a discussion of the vertical adjustability and the limited horizontal movement of the wall tie member. Although, as indicated above, the wall tie member is generally similar to the wall tie of U.S. Pat. No. 4,021,990, attention is drawn to an important difference in that the end portions 62,64 of the wall tie 16 are spaced apart and are generally parallel to each other while the wall tie previously described in U.S. Pat. No. 4,021,990 has end portions which are in general relative coplaner alignment. The configuration of the end portions 62,64 of the wall tie member 16 cooperate with the clip member 18 and form a novel feature of the present invention, as will be presently described.

The clip member 18 is a member of unitary construction which includes a base portion 66 and a plurality of substantially parallel projecting leg portions 68,70,72,74,76 defining a plurality of open channels 78,80,82,84.

The spacing between projecting leg portions 68,70,72,74,76 is proportioned in a manner such that the channels 82,84 formed therebetween accept the end portions 62,64 of the wall tie member 16. The spacing between the projecting leg portions 68,70 and between the projecting legs 70,72 are sufficiently different such that continuous wires or rods 20 of two preselected diameters may be selectively inserted in the channel 78 or in the channel 80. The top portion of the projecting leg portions, 68,70,72,74 each include a lip portion 86 which aids in locking the ends of the wall tie member 16 and the continuous wire 20 to the clip member, as is shown in FIG. 1.

Figure 4:
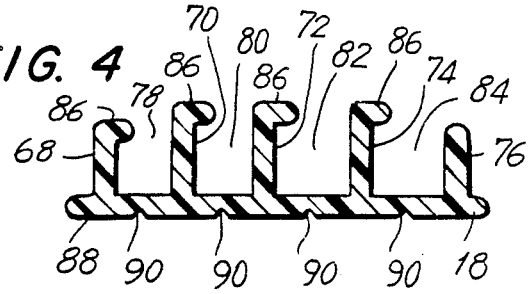
FIG. 4 is a cross-sectional view taken along the line 4—4 of FIG. 3.

As shown in FIG. 4, the channels may be provided with interior longitudinally extending ridges, shown in phantom and designated by the reference numeral 91, to positionally secure the continuous wire and wall tie end portions within the channels. In this configuration the lip portions 86 may be retained or removed.

In the preferred embodiment of the clip member 18, shown in FIG. 4, the projecting leg portions 68,76 are somewhat shorter than the projecting leg portions 70,72,74. In accordance with the preferred embodiment, the channel 78 is proportioned to accept a nine gauge continuous wire 20 while the channel 80 is proportioned to accept a 3/16 inch diameter continuous wire. The channels 82,84 are each proportioned to accept a 3/16 inch diameter wire which forms the end portions 62,64 of the wall tie member 16.

It is clear that the proportions of the channels 78,80,82,84 may be varied in order to accommodate continuous wires of different diameters and wall ties which are formed of wire other than the 3/16 inch diameter of the tie in the preferred embodiment. In practice it is common to utilize wall ties formed of 3/16 inch diameter stock and accordingly alternative clip members are provided in which channel 78 is proportioned to receive a nine gauge continuous wire as previously indicated and channels 80,82,84 are each proportioned to receive 3/16 inch diameter wire. The clip member is preferably formed of an extrudable plastic such as rigid polyvinylchloride using an extrusion process. In practice, the ends of the reinforcing wire are disposed in overlapping relationship within the mortar joint. However, it is within the contemplation of the present invention to have the adjacent ones of the continuous wires positioned in abutting end-to-end relationship within a selected channel of a selected clip to thereby form the continuous reinforcement.

The bottom portion 88 of the clip member 18 has a plurality of parallel V-shaped or notched grooves 90 which facilitate the bonding of the clip member 18 to the mortar which fills the horizontal joints between the stones 26. During the construction of the outer wythe 24, the mortar also fills the channels 78,80,82,84 of the clip 18 thereby bonding the clip 18, the reinforcing wire and the wall tie member 16 together and forming a strong and well reinforced structure.

While I have shown and described the prefered embodiments of the present invention, it will be readily apparent to those skilled in the art that there are many changes, modifications, and improvements which can be made therein without departing from the spirit and scope of the present invention as hereinabove defined and envisioned and as hereinafter claimed.

What is claimed is:

1. A seismic construction system comprising a plurality of support members secured with respect to each other and forming the frame of an edifice, at least one barrier layer means disposed in abutting engagement with the outer surface portion of selected ones of said support members, at least one veneer anchor member disposed in proximate relationship with the front surface of said barrier layer means, said veneer anchor member comprising a plate member, a projecting bar member, and end members, means for fixedly securing said projecting bar member to said plate member in a manner to form a slot therebetween, a wall tie member having a first end portion and a second end portion, said first end portion being positionally disposed in the slot between said plate member and said projecting bar member of said veneer anchor member, a clip member comprising, a base member, said base member including first and second attachment means formed thereon, said second end portion of said wall tie member being secured to said first attachment means of said clip member, wire reinforcing means secured to said second attachment means of said clip member, an outer wythe assembly, and said second end portion of said wall tie member, said clip member, and said wall reinforcing means being positionally securable along the longitudinal dimension of said outer wythe assembly, to thereby secure said wall tie member and said wire reinforcement means with respect to said outer wythe assembly.

2. A seismic construction system in accordance with claim 1, wherein said reinforcing wire means extends longitudinally.

3. A seismic construction system in accordance with claim 1, wherein said clip member comprises a plurality of spaced apart leg portions projecting from said base member.

4. A seismic construction system in accordance with claim 3, wherein selective ones of said leg portions include integrally formed lip portions.

5. A seismic construction system in accordance with claim 3, wherein selected ones of said leg portions include longitudinally extending ridges.

6. A seismic construction system in accordance with claim 3, wherein said leg portions are disposed in spaced apart parallel relationship with respect to one another thereby forming a plurality of parallel channels therebetween which form said first and second attachment means.

7. A seismic construction system in accordance with claim 6, wherein at least one of said channels is selectively proportioned to positionally accept said second end portion of said wall tie member.

8. A seismic construction system in accordance with claim 6, wherein a pair of adjacent selected channels are proportioned to accept said second end portion of said wall tie member.

9. A seismic construction system in accordance with claim 1, wherein said clip member is of unitary construction 10. A seismic construction system in accordance with claim 1, wherein said clip member is formed from a plastic material.

11. A seismic construction system in accordance with claim 10, wherein said base member of the clip member has a plurality of grooves formed on the underside thereof.

12. A seismic construction system in accordance with claim 1, wherein said wall tie member comprises an apex portion, a pair of converging leg portions, and a base portion, said converging leg portions projecting toward said apex portion, and said base portion comprising a pair of spaced apart members.

13. A seismic construction system in accordance with claim 12, wherein said spaced apart members are disposed in substantially parallel relationship.

14. A seismic construction system in accordance with claim 12, wherein said apex portion has a longitudinal extension which is disposed in substantially parallel relationship with respect to said base portion.

15. A seismic construction system in accordance with claim 14, wherein said clip member comprises a plurality of spaced apart parallel leg portions projecting from said base member thereby forming a plurality of parallel channels between said leg portions, a first one of said spaced apart base portion members of said wall tie member being ensconced in a first one of said parallel channels, and a second one of said spaced apart base portion members of said wall tie member being ensconced in a second one of said parallel channels.

16. A seismic construction system in accordance with claim 15, wherein said first and second parallel channels are disposed in adjacent proximate relationship.

17. A seismic construction system in accordance with claim 15, wherein said wire reinforcing means are ensconced in a third one of said parallel channels.

18. A seismic construction system in accordance with claim 16, wherein said wall reinforcing means comprises a longitudinally extending wire member.

19. A seismic construction system in accordance with claim 17, wherein said wall reinforcing means comprises a pair of longitudinally extending wire members, and said wire members being disposed within said third parallel channel in end to end abutting engagement.

20. In a construction system employing a clip member which has other members secured thereto and interconnected between the inner and outer wythes of the construction system, the improvement comprising a clip member having a base member, and at least three spaced apart leg portions, said spaced apart leg portions projecting from a first surface of said base member.

21. An improvement in accordance with claim 20, wherein said leg portions are disposed in spaced apart parallel relationship with respect to one another to thereby form a plurality of spaced apart parallel channels.

22. An improvement in accordance with claim 21, wherein said leg portions project upwardly from the upper surface of said base member.

23. An improvement in accordance with claim 22, wherein a plurality of spaced apart grooves are formed on the lower surface of said base member.

24. An improvement in accordance with claim 22, wherein selected ones of said leg portions have lip portions extending from the upper ends thereof.

25. A clip member for use in the fabrication of seismic construction systems in accordance with claim 24, wherein selected ones of said leg portions include longitudinally extending ridges.

26. An improvement in accordance with claim 24, wherein said lip portions are disposed in substantially parallel relationship with said base member.

27. In accordance with claim 26, wherein said clip member is of unitary construction.

28. In accordance with claim 27, wherein said clip member is constructed of a plastic material.

29. An improvement in accordance with claim 28, wherein a plurality of spaced apart grooves are formed on the lower surface of said base member.

30. A clip member securement assembly for use in the construction of seismic construction systems having an inner wythe and an outer wythe, said securement assembly comprising a clip member, and a wall tie member, said clip member comprising a base member, and a plurality of spaced apart leg portions, said wall tie member including an end portion comprising a pair of spaced apart members, said spaced apart leg portions projecting from a first surface of said base member in substantially parallel relationship with respect to one another to thereby form a plurality of spaced apart substantially parallel channels, and wherein said spaced apart leg portions form the channel sides and said first surface forms the channel base, said spaced apart wall tie end members being positionally secured in at least a selected one of said parallel channels.

31. A clip member securement assembly for use in the construction of seismic construction systems having an inner wythe and an outer wythe in accordance with claim 30, wherein said spaced apart members of the end portion of said wall tie members are disposed in askew parallel relationship, a first one of said spaced apart wall tie end members being positionally secured in a first one of said parallel channels, and a second one of said spaced apart wall tie end members being positionally secured in a second one of said parallel channels.

32. A clip member securement assembly for use in the construction of seismic construction systems having an inner wythe and an outer wythe in accordance with claim 31, wherein said first and second parallel channels are disposed in adjacent proximate relationship.

33. A clip member securement assembly for use in the construction of seismic construction systems having an inner wythe and an outer wythe in accordance with claim 32, wherein said leg portions of said clip member project upwardly from the upper surface of the base member.

34. A clip member securement assembly for use in the construction of seismic construction systems having an inner and an outer wythe in accordance with claim 33, wherein selected ones of said leg portions include longitudinally extending ridges.

35. A clip member securement assembly for use in the construction of seismic construction systems having an inner wythe and an outer wythe in accordance with claim 33, wherein selected ones of said leg portions have lip portions extending from the upper ends.

36. A clip member securement assembly for use in the construction of seismic construction systems having an inner wythe and an outer wythe in accordance with claim 34, wherein said lip portions are disposed in substantially parallel relationship with said base member.

37. A clip member securement assembly for use in the construction of seismic construction systems having an inner wythe and an outer wythe in accordance with claim 36, wherein said clip member is of unitary construction.

38. A clip member securement assembly for use in the construction of seismic construction systems having an inner wythe and an outer wythe in accordance with claim 37, wherein said clip member is constructed of a plastic material.

39. A clip member securement assembly for use in the construction of seismic construction systems having an inner wythe and an outer wythe in accordance with claim 38, wherein said first and second spaced apart wall tie end members are esconced in said first and second parallel channels, respectively.

40. A clip member securement assembly for use in the construction of seismic construction systems having an inner wythe and an outer wythe in accordance with claim 39, wherein a plurality of spaced apart grooves are formed on the lower surface of said base member.

41. A clip member securement assembly for use in the construction of seismic construction systems having an inner wythe and an outer wythe in accordance with claim 39, including wall reinforcing means ensconced in a third one of said parallel channels.

42. A clip member securement assembly for use in the construction of seismic construction systems having an inner wythe and an outer wythe in accordance with claim 41, wherein said wall reinforcing means comprises a longitudinally extending wire member.

43. A clip member securement assembly for use in the construction of seismic construction systems having an inner wythe and an outer wythe in accordance with claim 41, wherein said wall reinforcing means comprises a longitudinally extending wire members.

* * * * *